US008297944B2

(12) United States Patent
Chou

(10) Patent No.: US 8,297,944 B2
(45) **Date of Patent: *Oct. 30, 2012**

(54) AIR COMPRESSOR HAVING QUICK COUPLING DEVICE

(76) Inventor: Wen San Chou, Tainan Hsien (TW)

( * ) Notice: Subject to any disclaimer, the term of this patent is extended or adjusted under 35 U.S.C. 154(b) by 898 days.

This patent is subject to a terminal disclaimer.

(21) Appl. No.: 12/290,796

(22) Filed: Nov. 4, 2008

(65) Prior Publication Data

US 2010/0111719 A1 May 6, 2010

(51) Int. Cl.
*F04B 41/02* (2006.01)
*F04B 35/00* (2006.01)
*F16L 37/00* (2006.01)

(52) U.S. Cl. ..... 417/313; 417/360; 417/321; 285/33

(58) Field of Classification Search ..... 417/415
See application file for complete search history.

(56) References Cited

U.S. PATENT DOCUMENTS 1,672,086 A * 6/1928 Rainsford et al. ..... 165/47
6,846,162 B2 1/2005 Chou ..... 417/63
7,240,642 B2 7/2007 Chou ..... 123/41.35
7,458,784 B2 * 12/2008 Vos et al. ..... 417/234
2004/0017083 A1 * 1/2004 Balamuta et al. ..... 285/390
2004/0057843 A1 * 3/2004 Haller et al. ..... 417/310
2004/0126247 A1 * 7/2004 Broser et al. ..... 417/312
2005/0006903 A1 * 1/2005 Yumita et al. ..... 290/43
2007/0077157 A1 * 4/2007 Chou ..... 417/437
2010/0147416 A1 * 6/2010 Chou ..... 141/38

* cited by examiner

*Primary Examiner* — Tracie Y Green

(74) *Attorney, Agent, or Firm* — Charles E. Baxley

(57) ABSTRACT

An air compressing device includes a piston slidably engaged in a cylinder housing and driven by a motor to generate a pressurized air, the cylinder housing includes an outlet tube, and an outlet port extended from the outlet tube, and an anchor plate extended from the outlet port, and a facility includes a coupler for engaging with the outlet port and the anchor plate and for quickly and detachably securing the coupler and the facility to the outlet port of the outlet tube and for allowing the pressurized air to be supplied to the facility. The facility is selected from a hose, a relief valve, a pressure gauge, or a cover, and the coupler includes a C-shaped structure.

11 Claims, 6 Drawing Sheets

AIR COMPRESSOR HAVING QUICK COUPLING DEVICE

BACKGROUND OF THE INVENTION

1. Field of the Invention

The present invention relates to an air compressor, and more particularly to an air compressing device including a quick coupling device for quickly coupling and attaching and securing various parts or elements or attachments or facilities to an outlet tube of the air compressor and also for quickly disengaging the parts or elements or attachments or facilities from the air compressor and thus for allowing the parts or elements or attachments or facilities to be quickly and changeably attached and secured to the outlet tube of the air compressor.

2. Description of the Prior Art

Various kinds of typical air compressing devices have been developed by the applicant and comprise a cylinder housing, a piston slidably received in the cylinder housing, and a motor coupled or attached to the cylinder housing and coupled to the piston for moving the piston relative to the cylinder housing in a reciprocating action, in order to generate a pressurized air of a greater air pressure and a decreased flowing quantity.

For example, U.S. Pat. No. 6,846,162 to Chou, and U.S. Pat. No. 7,240,642 to Chou disclose two of the typical air compressing devices each also comprising a piston slidably received or engaged in a cylinder housing, and a motor attached to the cylinder housing and coupled to the piston for moving the piston relative to the cylinder housing in a reciprocating action, in order to generate a pressurized air of a greater air pressure and a decreased flowing quantity and for supplying the pressurized air to inflate various air facilities, such as tires, air beds, air cushions, hovercrafts, etc.

The cylinder housing normally includes an outlet tube having one or more outlet ports for selectively attaching and securing or coupling various parts or elements or attachments or facilities, such as the pressure gauges, the air nozzles, the relief valves, the safety valves or the like.

However, normally, the outlet ports include a predetermined coupling structure for attaching and securing the predetermined parts or elements or attachments or facilities, but may not be used for attaching and securing the other parts or elements or attachments or facilities, and the parts or elements or attachments or facilities may not be changed with each other or may not be changeably attached and secured to different outlet ports of the outlet tube of the cylinder housing.

The present invention has arisen to mitigate and/or obviate the afore-described disadvantages of the conventional air compressor devices.

SUMMARY OF THE INVENTION

The primary objective of the present invention is to provide an air compressing device including a quick coupling device for quickly coupling and attaching and securing various parts or elements or attachments or facilities to an outlet tube of the air compressor and also for quickly disengaging the parts or elements or attachments or facilities from the air compressor and thus for allowing the parts or elements or attachments or facilities to be quickly and changeably attached and secured to the outlet tube of the air compressor.

In accordance with one aspect of the invention, there is provided an air compressing device comprising a cylinder housing, a piston slidably engaged in the cylinder housing, a piston rod extended from the piston, and a motor attached to the cylinder housing and coupled to the piston rod with a coupling device for moving the piston relative to the cylinder housing in a reciprocating action, in order to generate a pressurized air, the cylinder housing includes an outlet tube extended outwardly therefrom and communicating with the cylinder housing for receiving the pressurized air from the cylinder housing, and includes an outlet port provided on the outlet tube and having a bore formed in the outlet port and communicating with the outlet tube for receiving the pressurized air from the outlet tube and the cylinder housing, and includes an anchor plate extended from the outlet port, and a facility includes a coupler for engaging with the outlet port and the anchor plate and for detachably securing the coupler and the facility to the outlet port of the outlet tube and for allowing the pressurized air to be supplied to the facility and for allowing the facility to be quickly and changeably attached and secured to the outlet tube of the cylinder housing.

The facility includes a mouth extended into the coupler for engaging into the bore of the outlet port of the outlet tube. The anchor plate includes a width greater than a height of the anchor plate for forming a rectangular structure, and includes two rounded corners oppositely formed thereon for allowing the coupler to be rotated relative to the anchor plate and to be coupled or secured to the outlet port of the outlet tube.

The coupler includes a base plate, and two arms extended from the base plate and spaced from each other for forming a space between the arms and for forming a C-shaped retaining space in the coupler and for detachably engaging with the anchor plate. The coupler includes an inwardly folded flange extended from each arm for partially closing the space and for hooking or engaging with the anchor plate and for easily and quickly and detachably locking or securing the facility and the coupler to the outlet port of the outlet tube.

The outlet port may be formed on a free end portion of the outlet tube and aligned with the outlet tube, or the outlet port is laterally extended from the outlet tube. The facility may be selected from a hose, a relief valve, a pressure gauge, or a cover, and the cover includes a knob extended therefrom for rotating the cover relative to the outlet port. The hose may be coupled to a nozzle for supplying the pressurized air to inflate to various air facilities, such as tires, air beds, air cushions, hovercrafts, etc.

The cylinder housing includes a valve seat disposed and located between the cylinder housing and the outlet tube, and a spring-biased check valve device disposed in the outlet tube and engaged with the valve seat for controlling the pressurized air to selectively flow into the outlet tube only and for preventing the pressurized air from flowing back form the outlet tube into the cylinder housing.

A receptacle may further be provided and includes a chamber formed therein for receiving the outlet tube and the cylinder housing and the motor and the facility, and the receptacle may include a lower receptacle member and an upper receptacle member each having one or more studs for detachably securing the receptacle members together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
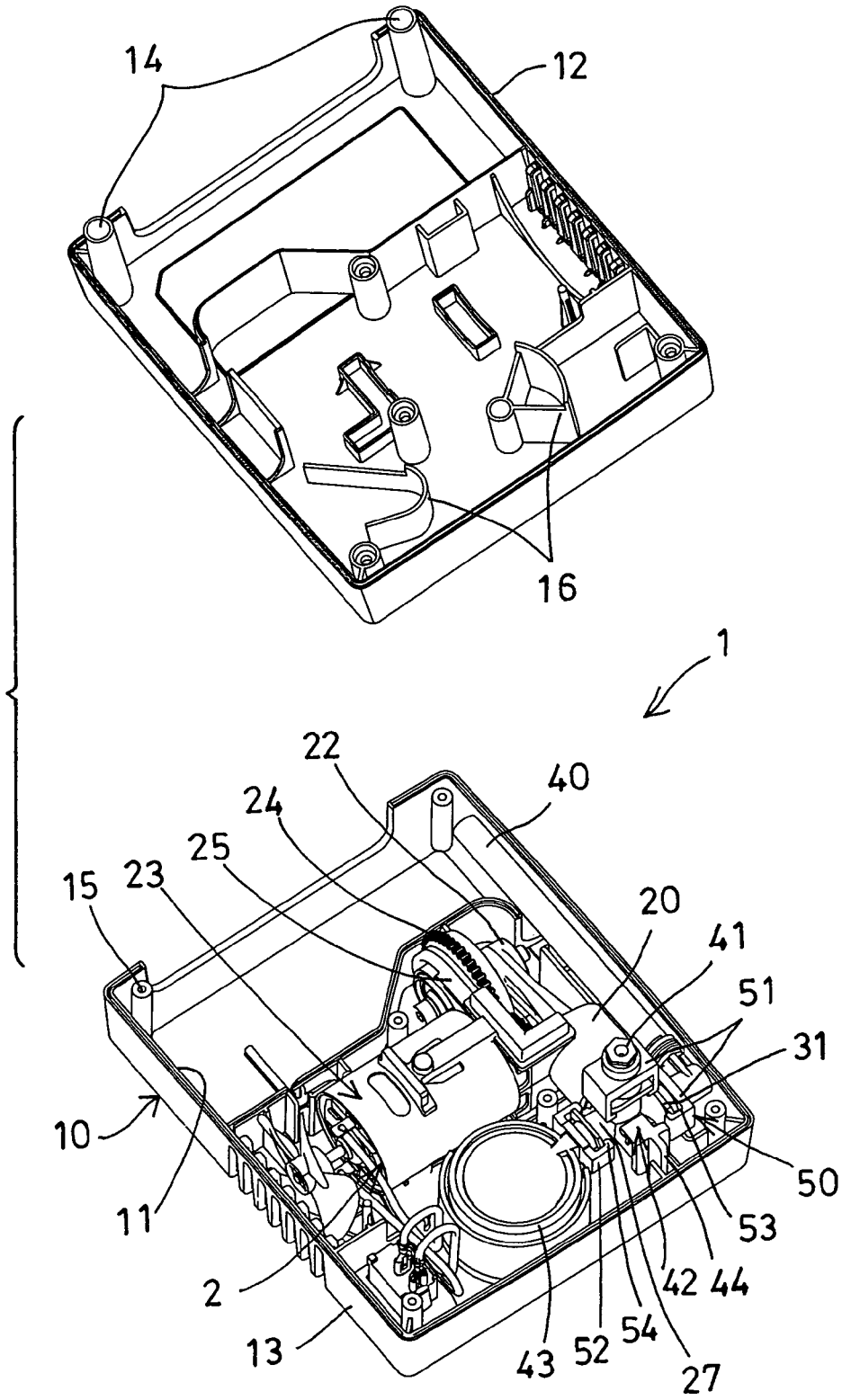
FIG. 1 is a partial exploded view of an air compressing device in accordance with the present invention.

Referring to the drawings, and initially to FIGS. 1-4, an air compressing assembly 1 in accordance with the present invention comprises an outer receptacle 10 including a chamber 11 formed therein and formed or defined by a lower receptacle member 12 and an upper receptacle member 13, in which the receptacle members 12, 13 each include one or more studs 14, 15 formed or provided therein and aligned with or engageable with each other for engaging with the latches or locks or fasteners (not shown), and for detachably securing the receptacle members 12, 13 together and for closing the chamber 11 of the receptacle 10 and for stably retaining the parts or elements or attachments or facilities in the chamber 11 of the receptacle 10.

An air compressing device 2 includes a cylinder housing 20 received and attached and secured in the chamber 11 of the receptacle 10, a piston 21 (FIG. 4) slidably engaged in the cylinder housing 20, a piston rod 22 attached or secured to or extended from the piston 22, and a motor 23 attached and secured to the cylinder housing 20 and coupled to the piston rod 22 with an eccentric or gear coupling device 24 for moving the piston 22 relative to the cylinder housing 20 in a reciprocating action, in order to generate a pressurized air of a relatively greater air pressure and a decreased flowing quantity. Two examples of the typical air compressing devices are disclosed in U.S. Pat. No. 6,846,162 to Chou, and U.S. Pat. No. 7,240,642 to Chou which may be taken as a reference for the present invention.

For example, the cylinder housing 20 includes a carrier plate 25 disposed and secured or attached or extended from cylinder housing 20 and arranged substantially parallel to the piston rod 22 for attaching or mounting the motor 23 and for coupling or securing the motor 23 to the cylinder housing 20. The cylinder housing 20 includes an outlet tube 26 extended outwardly therefrom and communicating with the cylinder housing 20 for receiving the pressurized air from the cylinder housing 20, and includes one or more (such as four) outlet ports 27 formed or provided or extended from the outlet tube 26 for coupling to various parts or elements or facilities 40-43 which will be discussed hereinafter.

Figure 2:
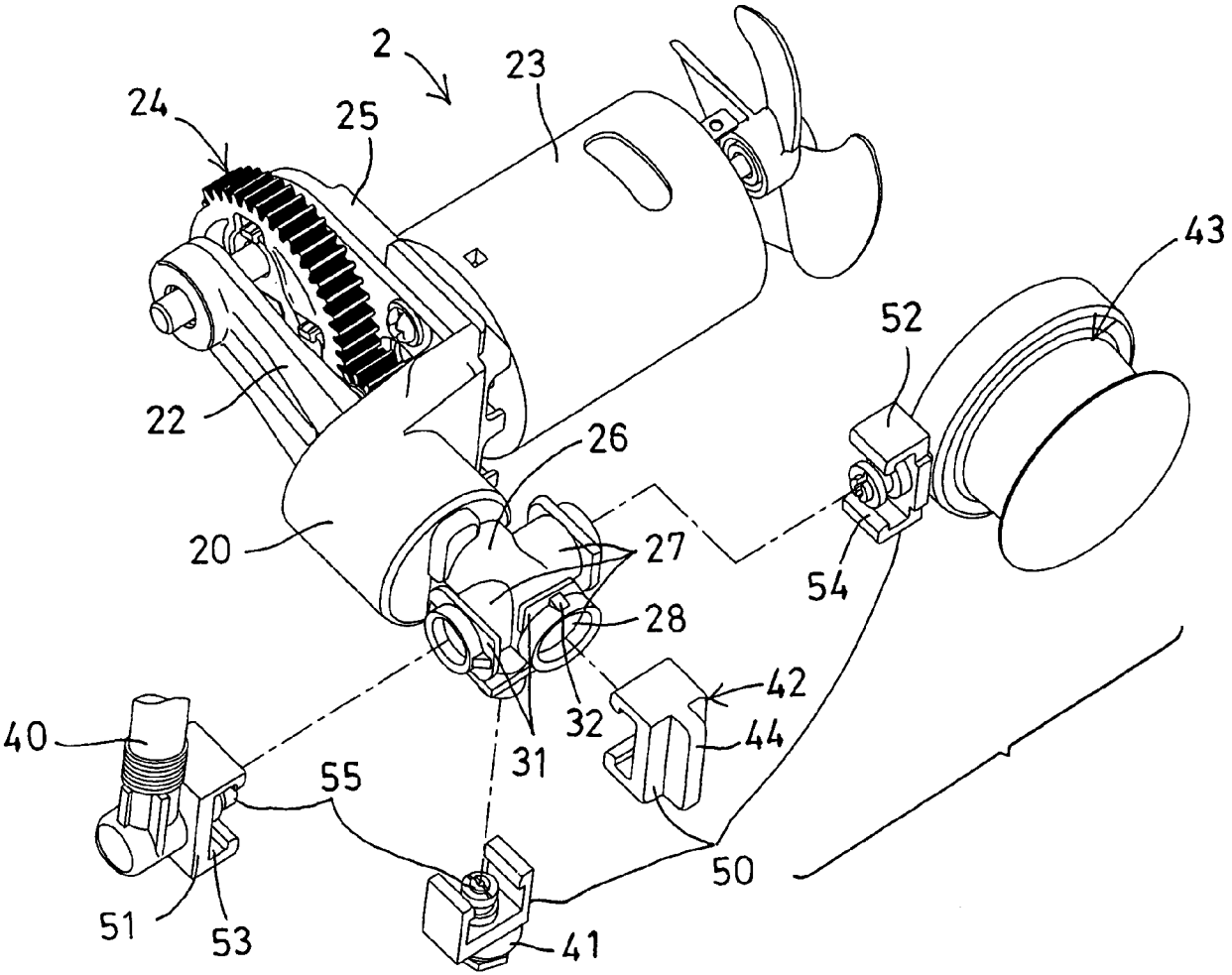
FIG. 2 is another partial exploded view of the air compressing device.
Figure 3:
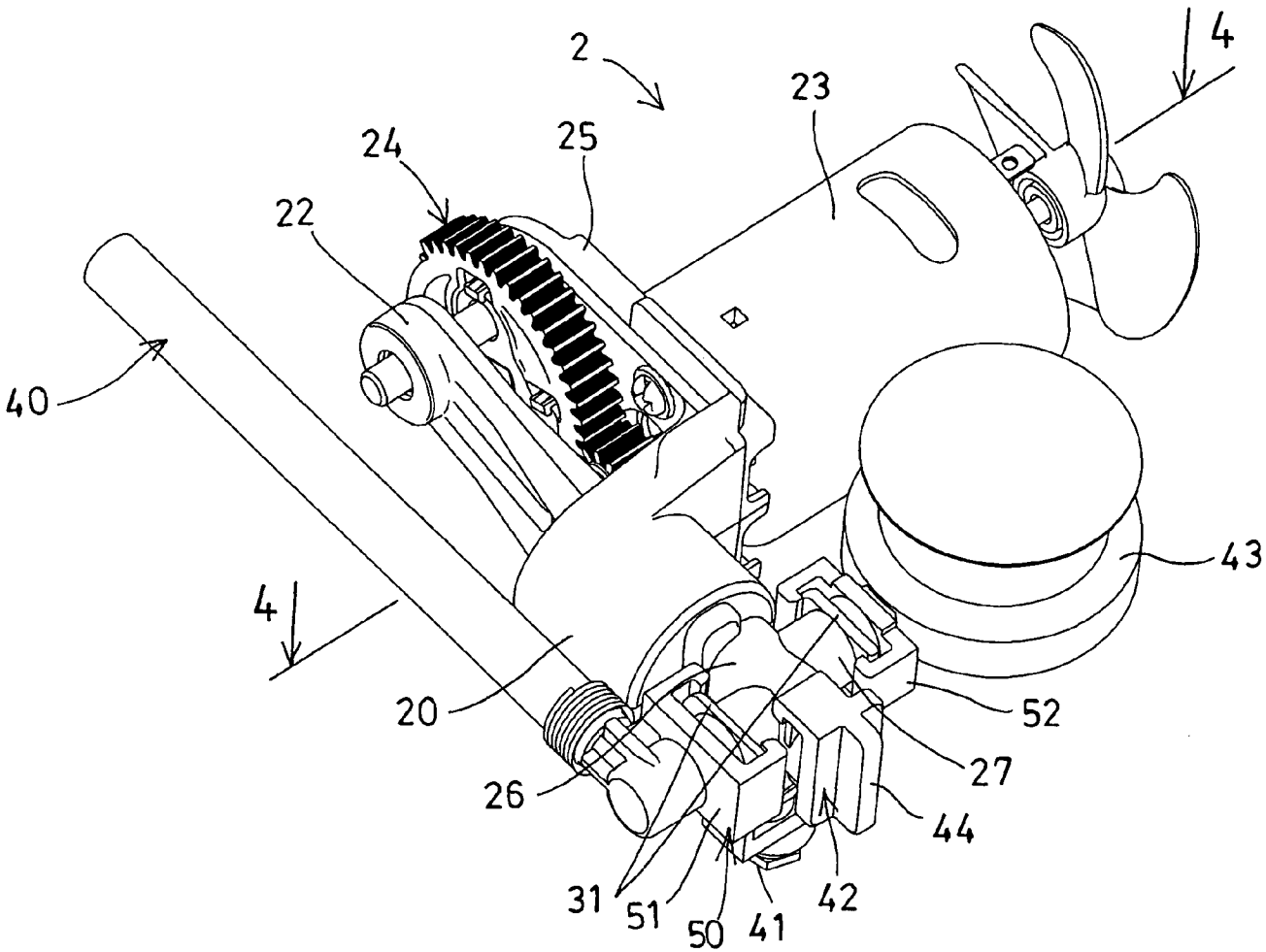
FIG. 3 is a partial bottom perspective view of the air compressing device, in which a portion of the air compressing device has been removed for illustrating the inner structure of the air compressor.
Figure 4:
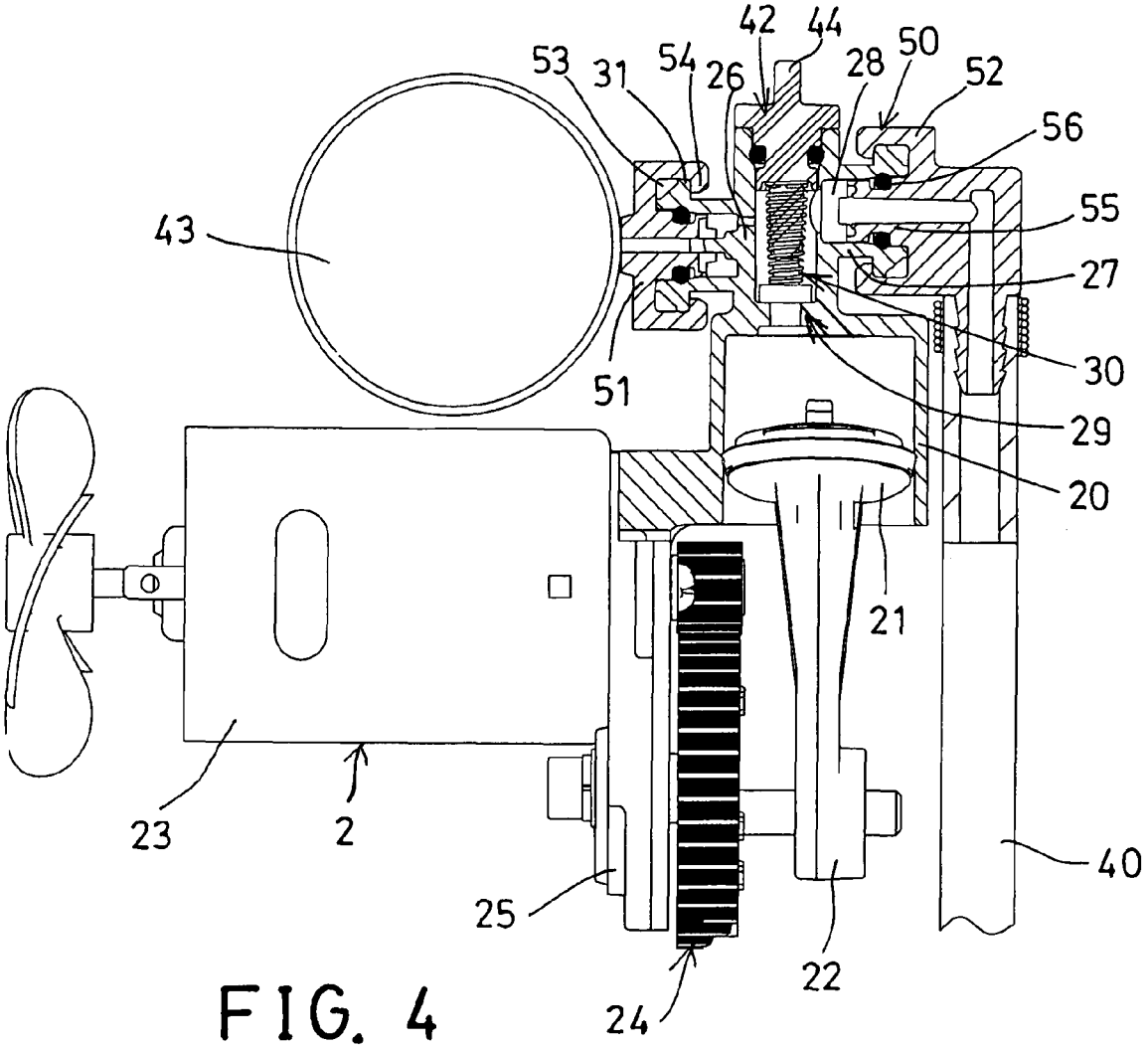
FIG. 4 is a partial cross sectional view of the air compressing device, taken along lines 4-4 of FIG. 3.

As shown in FIGS. 2 and 4, one of the outlet ports 27 is formed on the free end portion of the outlet tube 26 and aligned with the outlet tube 26, two other outlet ports 27 are oppositely or laterally extended from the side portions of the outlet tube 26, and another outlet port 27 is extended downwardly or laterally from the outlet tube 26 (FIGS. 1-3, and 5) and perpendicular to the outlet tube 26. The outlet ports 27 each include a bore 28 formed therein and communicating with the outlet tube 26 and the cylinder housing 20 for receiving the pressurized air from the outlet tube 26 and the cylinder housing 20, and for allowing the pressurized air to selectively flow out through either of the outlet ports 27 and then to flow into the parts or elements or facilities 40-43.

The cylinder housing 20 includes a valve seat 29 formed or provided in the upper portion of the cylinder housing 20 (FIG. 4) and disposed and located between the cylinder housing 20 and the outlet tube 26 for controlling the pressurized air to selectively flow into the outlet tube 26. As also shown in FIG. 4, a spring-biased check valve device 30 is disposed in the outlet tube 26 and engaged with the valve seat 29 for controlling the pressurized air to selectively flow into the outlet tube 26 unidirectionally, and for preventing the pressurized air from flowing back form the outlet tube 26 into the cylinder housing 20. The outlet tube 26 includes an anchor plate 31 attached or secured or extended from each of the outlet ports 27, and one or more projections or weldings or ribs 32 are formed and coupled or secured between the outlet ports 27 and the anchor plates 31 (FIGS. 2, 6) for reinforcing the outlet ports 27 and/or the anchor plates 31.

Figure 6:
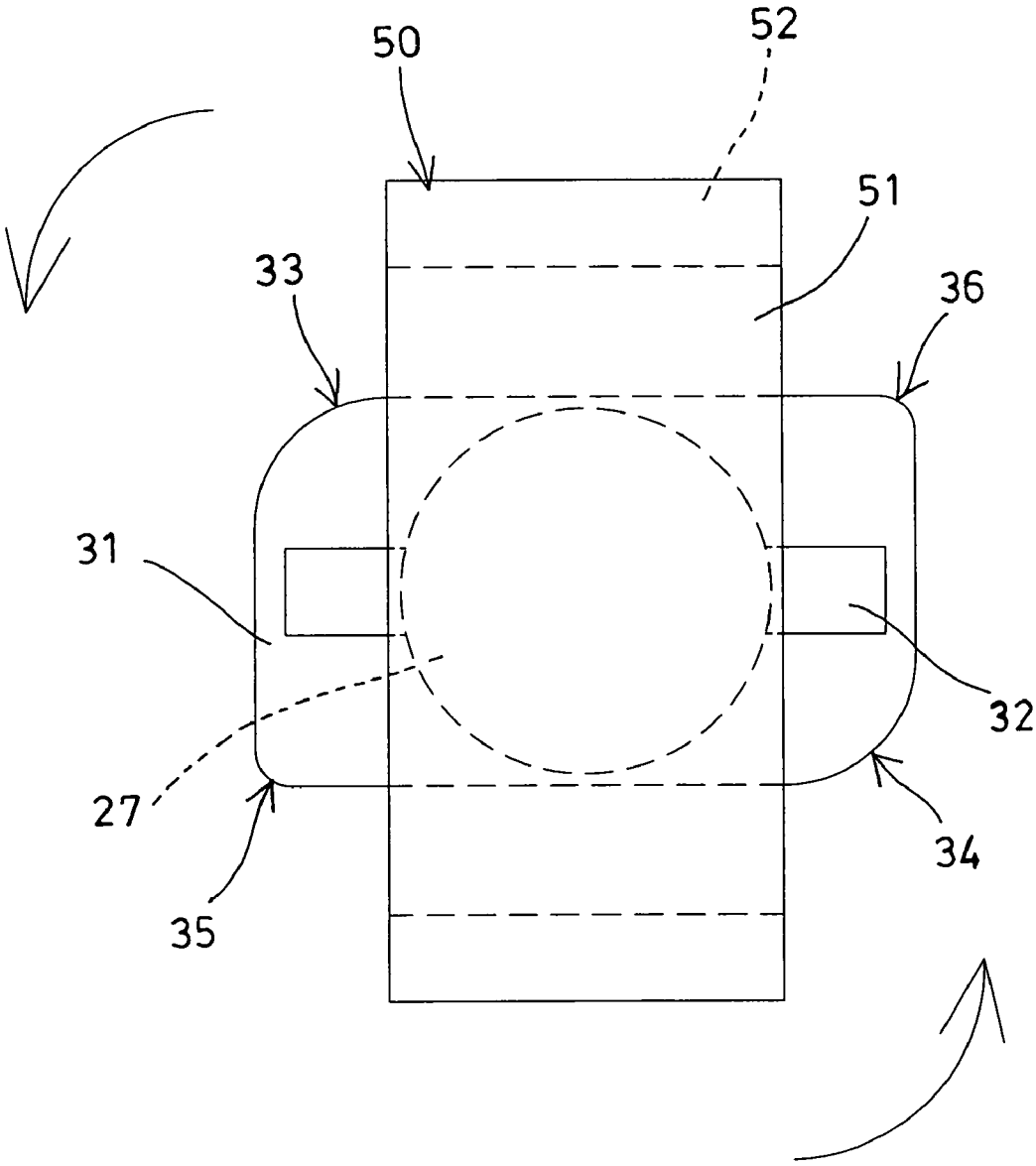
FIG. 6 is a plan schematic view illustrating a quick coupling device of the air compressing device.

As best shown in FIGS. 2 and 6, the anchor plates 31 each include a first dimension, such as a height or length or width greater than a second or another dimension, such as a width or length or height for forming a substantially parallelogrammic or rectangular structure, and each include two rounded corners 33, 34 oppositely formed or provided thereon, and each include two substantially straight or right-angled corners 35, 36 oppositely formed or provided thereon. The parts or elements or facilities 40-43 may be selected from a hose 40, a safety or relief valve 41, a cover 42, a pressure gauge 43 or the like, and each include a substantially C-shaped attachment or coupler 50 for quickly and detachably attaching or securing the facilities 40-43 to the outlet ports 27 of the outlet tube 26. The hose 40 may be coupled to a nozzle (not shown) for coupling to various air facilities, such as tires, air beds, air cushions, hovercrafts, etc.

The coupler 50 each include a base plate 51, and two limbs or arms 52 extended from the base plate 51 and extended away from the facilities 40-43 and spaced from each other for forming a space 53 between the arms 52, and an inwardly folded hook or flange 54 extended from each arm 52 for partially closing the space 53 and for forming a C-shaped locking or retaining space 53. As shown in FIG. 6, the distance between the arms 52 or the length of the space 53 of the coupler 50 is greater than the shorter dimension or the height of the anchor plate 31 for allowing the anchor plate 31 to be engaged into the space 53 of the coupler 50 and for allowing the base plate 51 to be engaged with the outlet ports 27 of the outlet tube 26 relatively.

The facilities 40-43 each include a mouth 55 extended therefrom and extended into the space 53 of the coupler 50 and disposed and located between the arms 52 and the flanges 54 for engaging into the bores 28 of the outlet ports 27 respectively when the base plate 51 is engaged with the outlet port 27 of the outlet tube 26 and/or when the anchor plate 31 is engaged into the space 53 of the coupler 50. The coupler 50 may then be rotated over the rounded corners 33, 34 of the anchor plate 31 and rotated counterclockwise (FIG. 6) and rotated relative to the outlet port 27 for about ninety (90) degrees, to have the arms 52 and/or the flanges 54 to engage with the side portions of the anchor plate 31 and to detachably attach and secure and lock the couplers 50 and the facilities 40-43 to the outlet ports 27 of the outlet tube 26.

As also shown in FIG. 4, a sealing ring 56 may be attached or engaged onto the mouth 55 of each coupler 50 or of each facility 40-43 for engaging with the outlet port 27 of the outlet tube 26 and for making an air tight seal between the outlet port 27 and the mouth 55 of the coupler 50 and for allowing the pressurized air to be effectively flown into the facilities 40-43 without leaking out of the outlet port 27 of the outlet tube 26. The cover 42 includes a hand grip or knob 44 extended therefrom for allowing the cover 42 to be easily rotated relative to the outlet port 27 with the knob 44. It is preferable that the receptacle 10 includes one or more protrusions 16 extended therefrom, such as extended inwardly into the lower receptacle member 12 (FIG. 1) for engaging with the facilities 40-43 and for stably retaining the facilities 40-43 in the chamber 11 of the receptacle 10.

Figure 5:
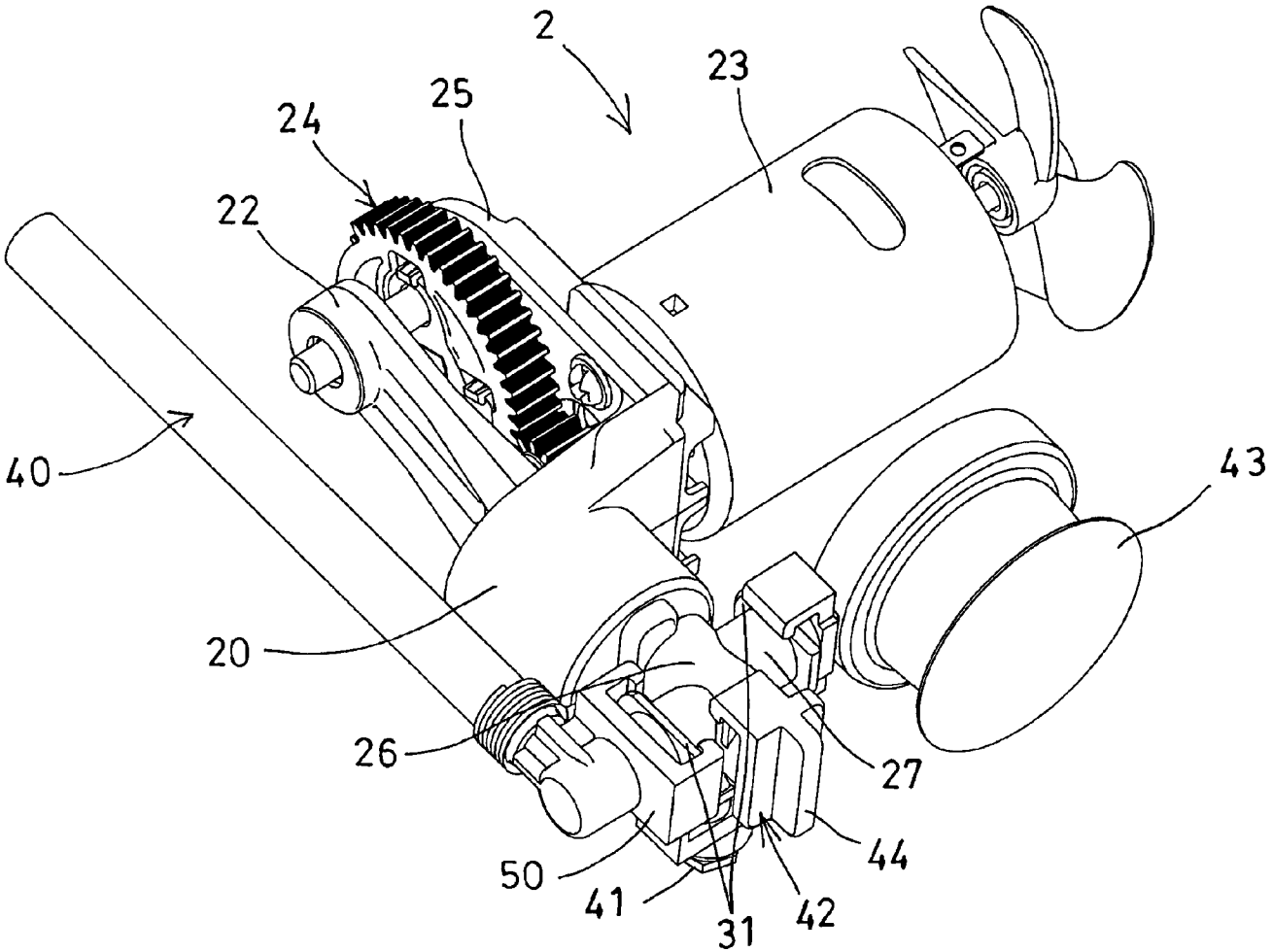
FIG. 5 is a partial bottom perspective view similar to FIG. 3, illustrating the operation of the air compressing device.

In operation, as shown in FIG. 5, the mouth 55 of the coupler 50 and of the pressure gauge 43 may first be engaged into the bore 28 of either of the outlet ports 27, and the base plate 51 may be forced to engage with the outlet port 27 of the outlet tube 26 and/or the anchor plate 31 may be engaged into the space 53 of the coupler 5. The coupler 50 and the pressure gauge 43 may then be rotated relative to the outlet port 27 for about ninety (90) degrees, to have the arms 52 and/or the flanges 54 to engage with the side portions of the anchor plate 31 and to detachably attach and secure and lock the couplers 50 and the facility or pressure gauge 43 to the outlet port 27 of the outlet tube 26.

It is to be noted that the facilities 40-43 may be easily and quickly and changeably attached and secured to either of the outlet ports 27 of the outlet tube 26 for allowing the facilities 40-43 to be attached to the suitable outlet ports 27 at the suitable locations or positions when required. When it is required to change the place of the facilities 40-43 or when it is required to disengage the facilities 40-43 from the outlet ports 27 of the outlet tube 26, the facilities 40-43 may be rotated clockwise relative to the outlet port 27 and to allow the couplers 50 and the facilities 40-43 to be easily and quickly disengaged from the outlet ports 27 of the outlet tube 26.

Accordingly, the air compressing device includes a quick coupling device for quickly coupling and attaching and securing various parts or elements or attachments or facilities to an outlet tube of the air compressor and also for quickly disengaging the parts or elements or attachments or facilities from the air compressor and thus for allowing the parts or elements or attachments or facilities to be quickly and changeably attached and secured to the outlet tube of the air compressor.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressing device comprising:

a cylinder housing, a piston slidably engaged in said cylinder housing, a piston rod extended from said piston, and a motor attached to said cylinder housing and coupled to said piston rod with a coupling device for moving said piston relative to said cylinder housing in a reciprocating action, in order to generate a pressurized air, said cylinder housing including an outlet tube extended outwardly therefrom and communicating with said cylinder housing for receiving the pressurized air from said cylinder housing, and including an outlet port provided on said outlet tube and having a bore formed in said outlet port and communicating with said outlet tube for receiving the pressurized air from said outlet tube and said cylinder housing, and including an anchor plate extended from said outlet port, and a facility including a coupler for engaging with said outlet port and said anchor plate and for detachably securing said coupler and said facility to said outlet port of said outlet tube and for allowing the pressurized air to be supplied to said facility, said coupler including a base plate, and two arms extended from said base plate and spaced from each other for forming a space between said arms and for forming a retaining space in said coupler and for engaging with said anchor plate, and said coupler including an inwardly folded flange extended from each arm for partially closing said space and for engaging with said anchor plate, and said anchor plate including two rounded corners oppositely formed thereon for allowing said coupler to be rotated relative to said anchor plate, said facility including a mouth extended into said coupler for engaging into said bore of said outlet port of said outlet tube.

2. The air compressing device as claimed in claim 1, wherein said anchor plate includes a width greater than a height of said anchor plate for forming a rectangular structure.

3. The air compressing device as claimed in claim 1, wherein said outlet port is formed on a free end portion of said outlet tube and aligned with said outlet tube.

4. The air compressing device as claimed in claim 1, wherein said outlet port is laterally extended from said outlet tube.

5. The air compressing device as claimed in claim 1, wherein said facility is a hose.

6. The air compressing device as claimed in claim 1, wherein said facility is a relief valve.

7. The air compressing device as claimed in claim 1, wherein said facility is a pressure gauge.

8. The air compressing device as claimed in claim 1, wherein said facility is a cover.

9. The air compressing device as claimed in claim 8, wherein said cover includes a knob extended therefrom.

10. The air compressing device as claimed in claim 1, wherein said cylinder housing includes a valve seat disposed and located between the cylinder housing and the outlet tube, and a check valve device disposed in said outlet tube and engaged with said valve seat for controlling the pressurized air to selectively flow into said outlet tube only and for preventing the pressurized air from flowing back form said outlet tube into said cylinder housing.

11. The air compressing device as claimed in claim 1, wherein a receptacle is further provided and includes a chamber formed therein for receiving said outlet tube and said cylinder housing and said motor and said facility.

* * * * *